United States Patent [19]

Ostergaard

[11] Patent Number: 4,726,526

[45] Date of Patent: Feb. 23, 1988

[54] AUTOMATIC ASPIRATOR-TRANSFER VALVE, AND A JET WASHING APPARATUS COMPRISING SUCH A VALVE

[75] Inventor: Tage Østergaard, Hadsund, Denmark

[73] Assignee: Knud Erik Westergaard, Hadsund, Denmark

[21] Appl. No.: 879,476

[22] Filed: Jun. 27, 1986

[30] Foreign Application Priority Data

Jul. 5, 1985 [DK] Denmark ..... 3103/85

[51] Int. Cl.[4] ..... B05B 7/04

[52] U.S. Cl. ..... 239/318; 137/895; 239/414

[58] Field of Search ..... 239/310, 312, 318, 413, 239/414; 137/891, 895

[56] References Cited

U.S. PATENT DOCUMENTS

| | | | |
|---|---|---|---|
| Re. 25,037 | 9/1961 | Brazier | 137/895 X |
| 2,719,704 | 10/1955 | Anderson et al. | 239/318 X |
| 2,800,313 | 7/1957 | Targosh et al. | 239/318 X |
| 3,282,227 | 11/1966 | Nielsen | 239/318 X |
| 3,613,997 | 10/1971 | Thompson | 239/310 |
| 3,787,006 | 1/1974 | Coanda | 239/318 X |

*Primary Examiner*—Andres Kashnikow
*Assistant Examiner*—Mary Beth O. Jones
*Attorney, Agent, or Firm*—Felfe & Lynch

[57] ABSTRACT

An automatic aspirator-transfer valve is disclosed which controls the delivery of washing and rinsing fluid from a supply to a cleaning gun. The device includes a valving piston which moves between a first or rinsing position to open communications to the bypass conduits and a second or washing position to close the bypass conduit. The injector aspirates washing fluid from a reservoir through a non-return valve, a side inlet and conduit of the side inlet, the side inlet conduit being separated from a passage within the housing bore. By this novel aspect, a user may change from the washing mode to the rinsing mode without the aspiration of dangerously high concentrations of washing agent and without unnecessary waste of the washing agent during operation.

9 Claims, 9 Drawing Figures

Figure 1:
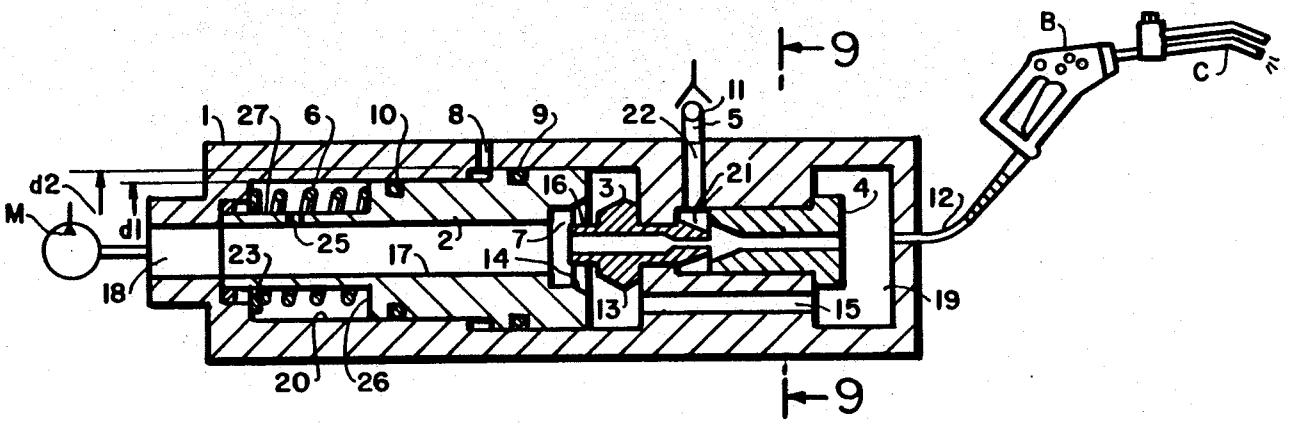

AUTOMATIC ASPIRATOR-TRANSFER VALVE, AND A JET WASHING APPARATUS COMPRISING SUCH A VALVE

The present invention relates to an automatic aspiratortransfer valve of the kind comprising (a) a housing with a first inlet and an outlet, (b) an injector placed between and communicating with said first inlet and said oulet and having a side inlet communicating with a second inlet on the outside of said housing, (c) a housing bore between and communicating with said first inlet and said injector, and (d) a valving piston with a passage interconnecting its both ends, the upstream end communicating with said housing inlet and the downstream end communicating with the inlet nozzle of said injector, said piston being slidable under the influence of variations in pressure differentials between surfaces facing upstream and surfaces facing downstream between a first, upstream-most position (FIGS. 1, 4 and 6), in which the downstream end of said piston passage communicates through an open valving gap between the downstream end of the piston and an upstream extension of said injector inlet nozzle with bypass conduits leading to said housing outlet, and a second, downstream-most position (FIGS. 3, 5 and 7), in which said valving gap is closed by the downstream end of said piston engaging said upstream extension.

Such a valve is disclosed in U.S. Pat. No. 3,613,997 (Richard G. Thompson), especially the specification's FIG. 3. In this known aspirator-transfer valve, the inlet path through the side inlet 25*a* of the injector 23*a*, 25*a*, 24*a* passes through the space inside the housing bore 16*a*, so that when the valve is in the mode (not shown) for adding washing agent from a housing side inlet 14*a*, i.e. when the valving piston 18*a* separates the upstream end of the bypass conduits 28*a* from the space inside the housing bore 16*a* to the outlet 15a, the entire said space inside the housing bore 16*a* will be filled with concentrated washing agent, only a non-return valve 26*a*, 27*a* preventing the washing agent from spreading further into said bypass conduits, or from being diluted by fluid from same, depending on relative pressures.

When changing from said washing-agent mode to the rinsing mode, in which the piston 18*a* is withdrawn upstream and allows washing fluid to pass directly from the housing inlet 13*a* to the housing outlet 15*a* through said bypass conduits 28*a*, the volume of washing agent present in said space inside the housing bore 16*a* will be flushed out through the outlet, causing a "plug" of concentrated washing agent to travel along the outlet hose 51 (vide FIGS. 1 and 2 of the same specification) to the cleaning gun 53. One disadvantage of this is that the ensuing concentration of washing agent applied to the object being treated may be higher than the material of said object will tolerate, so that irreparable damage may result. Another disadvantage is that the washing agent in its undiluted form may be dangerous for the operator, and a third disadvantage is the obvious waste of washing agent involved, as the transition from the washing mode to the rinsing mode represents a situation, in which the operator does not intend to use any more washing agent, but only the washing fluid, such as for rinsing after washing or scrubbing the object concerned.

It is the object of the present invention to provide an automatic aspirator-transfer valve of the kind referred to above, in which the disadvantages described above are eliminated or at least substantially reduced.

The above-mentioned object of the invention is attained in a valve of the kind referred to initially, which according to the invention is characterized in (e) that the connection between said side inlet of said injector and said housing second inlet is constituted by at least one conduit separate from said bypass conduits.

With such a valve, the washing agent is conducted to the side inlet of the injector through a path completely separated from the space inside the housing bore, so that the issuing and waste of concentrated washing agent described above is avoided. Furthermore, the non-return valve between said space and the bypass conduits is no longer necessary, and may be dispensed with, thus simplifying the construction of the valve.

The present invention also relates to a washing apparatus for alternately effecting washing at low pressure and high-pressure jet cleaning and of the kind comprising (a) a supply of washing fluid at high pressure, (b) a supply of washing agent to be admixed to said washing fluid during periods of washing at low pressure, (c) an automatic aspirator-transfer valve of the kind initially referred to, and (d) a gun comprising at least one outlet nozzle for fluid supplied through said valve from said supply or supplies, said gun having means for increasing the flow cross-sectional area in order to lower the pressure in the outlet from said valve for controlling its operation.

According to the present invention, this apparatus is characterized in (e) that said valve is a valve exhibiting the features of the present invention mentioned in paragraph (c) above, possibly also further features according to the invention to be described below, and (f) that said gun comprises more than one nozzle and is arranged alternately and under manual control to connect a smaller number of nozzles or a greater number of nozzles to the outlet of said valve, so as to effect the requisite change in flow cross-sectional area for controlling said valve.

The present invention is now to be explained in a more detailed manner with reference to the diagrammatic drawing, in which FIG. 1 shows a first exemplary embodiment of an automatic aspirator-transfer valve according to the present invention, shown in longitudinal section in the mode corresponding to high-pressure rinsing without washing agent.

Figure 2:
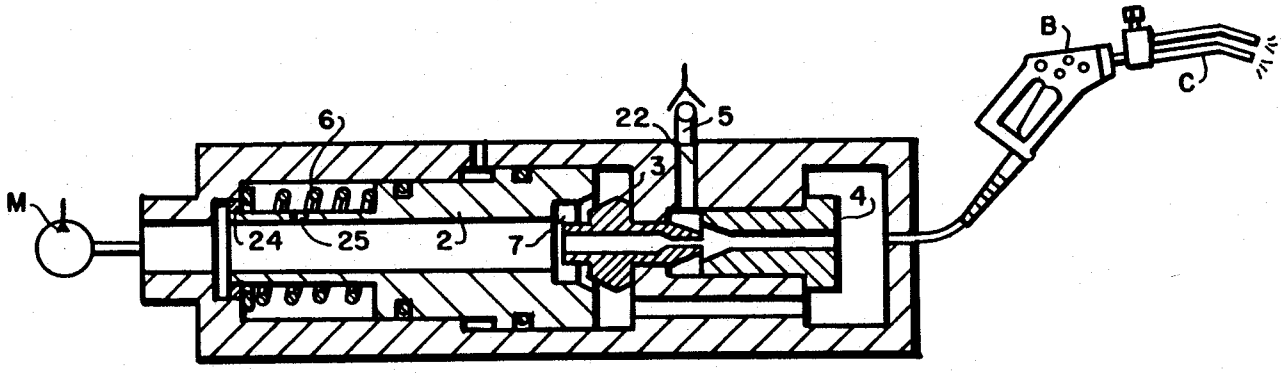
Figure 3:
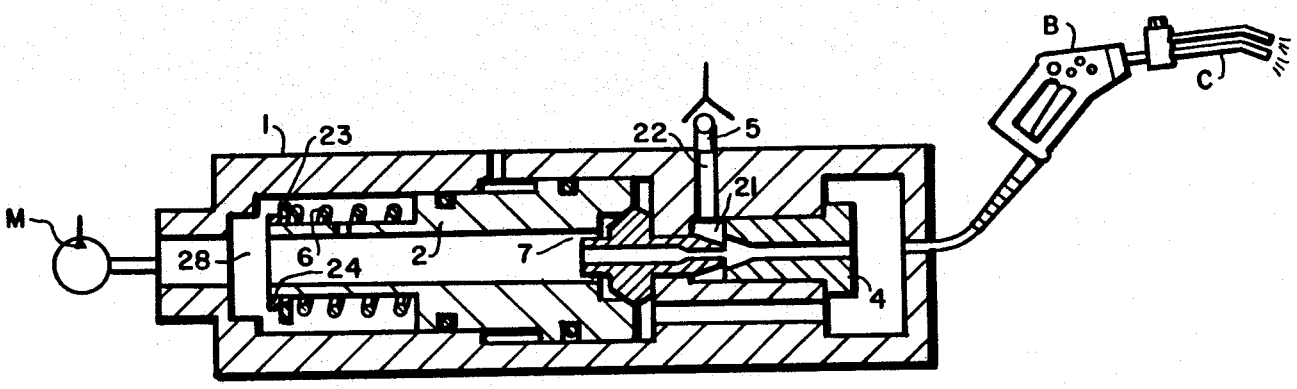
Figure 4:
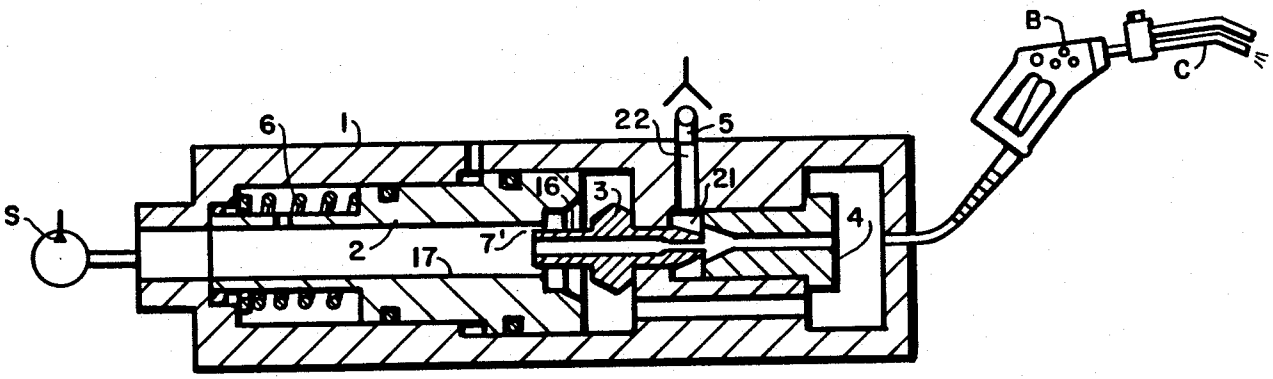
Figure 5:
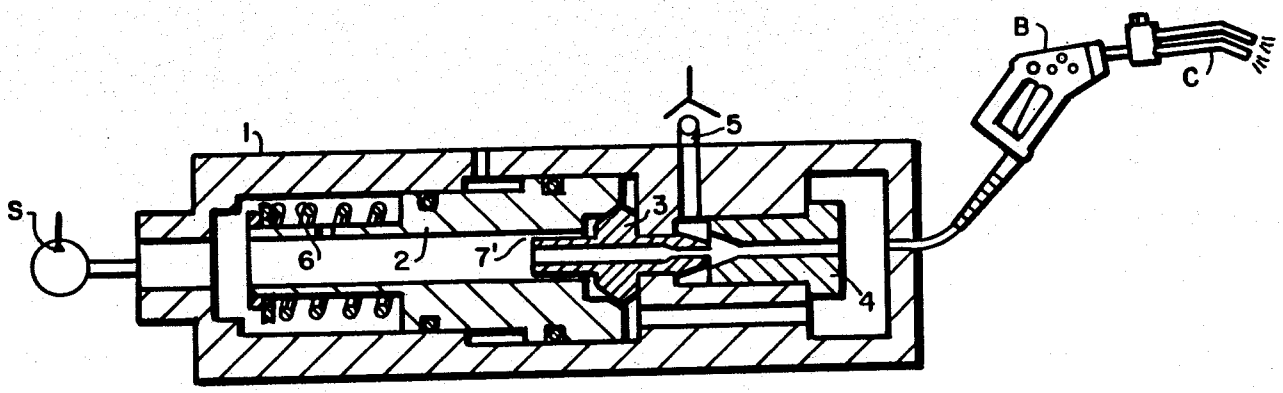
Figure 6:
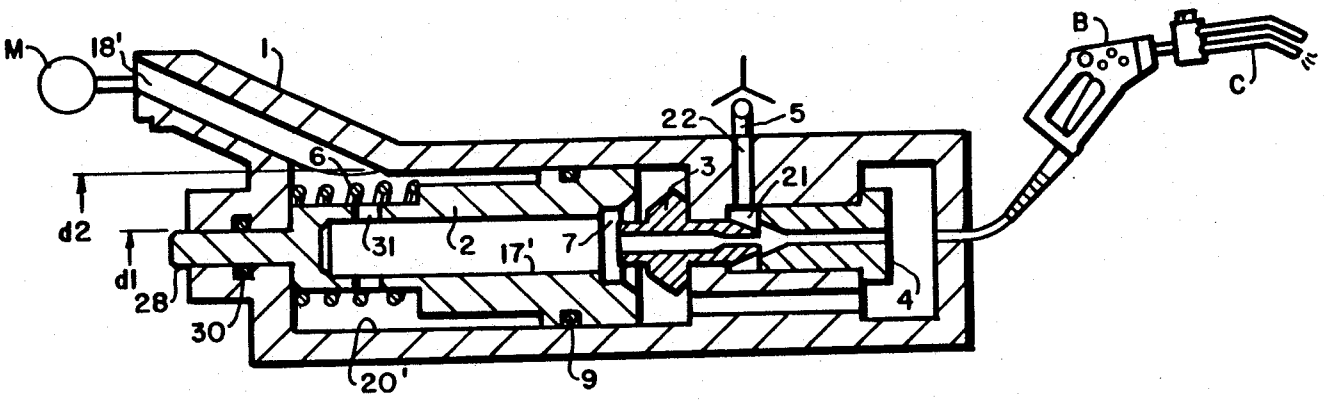
Figure 7:
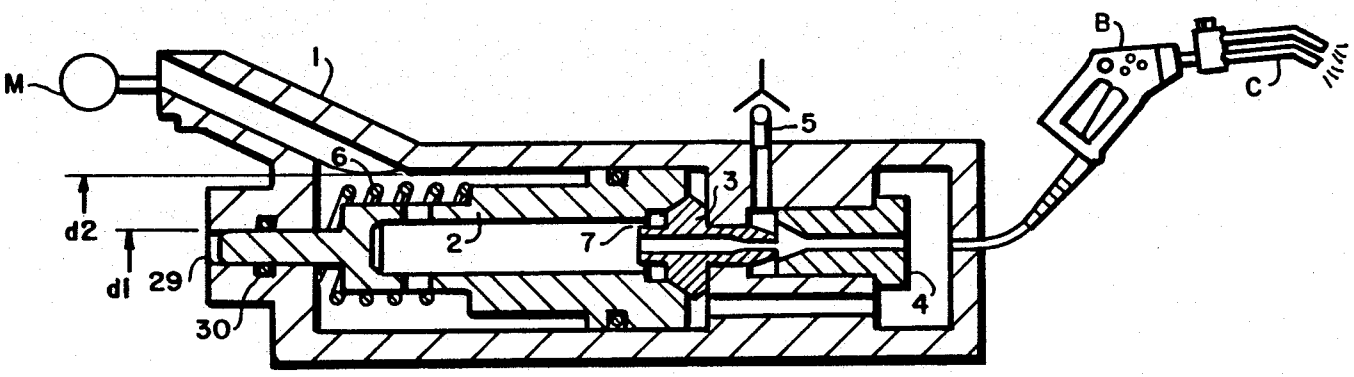

FIG. 2 in the same manner as FIG. 1 shows the same valve in an intermediate position between two modes of operation, FIG. 3 in the same manner as FIGS. 1 and 2 shows the same valve in an end position in a mode corresponding to low-pressure washing with a washing agent added to the washing fluid, FIGS. 4 and 5 in the same manner as FIGS. 1–3 show a second exemplary embodiment of a valve according to the present invention, in the high-pressure rinsing mode and the low-pressure washing mode respectively, FIGS. 6 and 7 in the same manner as above show a third exemplary embodiment of a valve according to the invention, in the high-pressure rinsing mode and the low-pressure washing mode respectively.

Figure 9:
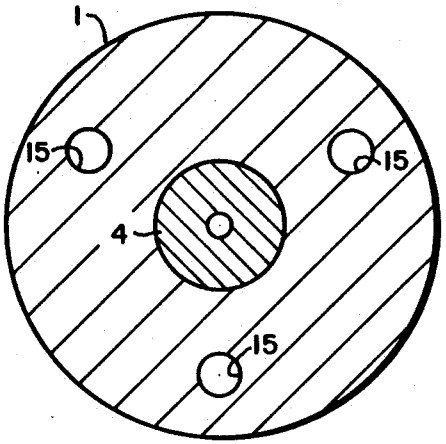
Figure 8:
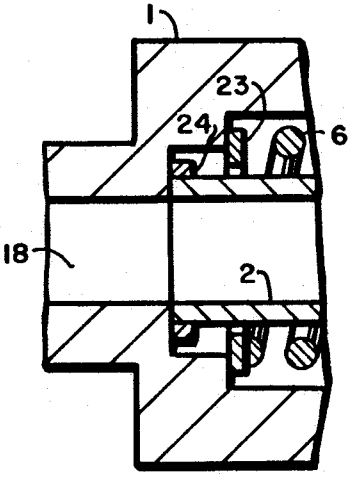

FIG. 8 is an enlarged cross sectional view of the relationship between the ring abutments 23, 24 and spring means 6 illustrated in FIGS. 1 and 2, and FIG. 9 is a cross sectional view taken along lines IX—IX of FIG. 1 illustrating at least three bypass conduits.

In the embodiment shown in FIGS. 1–3, an automatic aspirator-transfer valve comprises a housing 1 with an inlet 18 connected to a supply M (shown purely in symbolic form) arranged to deliver washing fluid, such as water, at a pressure of the order of at least 5–10 bars. The valve's outlet 19 is connected through a hose 12 to a cleaning gun B with two nozzles C, so arranged that one or two nozzles C or none of them may be connected to the hose 12 by manually operating suitable means on the gun B.

Directly communicating with said inlet 18 is a housing bore 20, in which a valving piston 2 is slidably supported in such a manner as to be movable from the upstream-most position shown in FIG. 1 to the downstream-most position shown in FIG. 3, FIG. 2 showing an intermediate transition position. The piston 2 has a passage 17 extending from its upstream end to its downstream end, thus connecting the housing inlet 18 to the downstream (right-hand) end of the bore 20 and to an inlet in the form of an upstream extension 16 on an injector inlet nozzle 3, said injector having a side inlet 21 and an outlet nozzle 4. The outlet nozzle 4 communicates with the housing outlet 19 referred to above.

The downstream end of the bore 20 also communicates with the housing outlet 19 through at least one bypass conduit (see also FIG. 9) bypassing the injector 3, its side inlet 21, and the outlet nozzle 4. The side inlet 21 of this injector communicates with the exterior of the housing 1 through an injector inlet conduit 22 and a housing side inlet 5, the latter communicating with a washing agent reservoir (not shown) through a non-return valve 11.

In the embodiment shown in FIGS. 1–3, as well as in the embodiment shown in FIGS. 4 and 5 to be described below, both the housing bore 20 and the valving piston 2 are stepped to form portions with two different effective diameters $d_1$ and $d_2$, the resultant difference in crosssectional area being in such a direction, that the pressure difference arising when the same pressure is applied to both ends tends to move the piston 2 in the upstream direction, i.e. towards the left in the drawing. Seals 9 and 10, a vent 8 and a hole 25 ensure the proper operation of the piston 2 in this respect, preventing both leakage and the formation of pressure pockets.

In the embodiment shown, a helical compression spring 6 is inserted on the piston 2 between an annular abutment surface 26 and a ring abutment 24, the latter ring 24 having a sufficiently small diameter to permit the upstream part 27 of the piston 2 to enter into a recess 28 formed at the upstream end of the housing bore 20, so that the spring 6 may be compressed on the upstream part 27 by a spring abutment ring 23 slidable on said upstream part, but not past the ring abutment 24, vide FIGS. 1, 2 and 8.

When the washing apparatus, of which the aspirator-transfer valve shown is a part, is put into operation, fluid pressure is first applied through the housing inlet 18, and then this fluid pressure is propagated through the piston passage 17 and from there through two paths, the first of which goes through the injector 3, its side inlet 21, and the outlet nozzle 4 to the outlet 19, and the second path through the bypass conduit(s) 15, likewise to the outlet 19. If at this stage only one of the two outlet nozzles C is open, the flow resistance downstream of the outlet 19 will be sufficient to maintain a considerable pressure in the housing bore 20, so that the pressure difference between $d_2$ and $d_1$ arising through the diameter difference referred to above will move the valving piston 2 upstream against the force of the spring 6 as shown in FIG. 1, thus creating an annular gap 7 of considerable flow cross-sectional area between the inside of the downstream end of the piston passage 17 and the outside of the upstream extension 16 on the inlet end of the injector 3, its side inlet 21, and the outlet nozzle 4. As the injector 3, its side inlet 21, and the outlet nozzle 4 are now substantially "shortcircuited" by the bypass-conduit(s) 15, the pressure difference between its ends is insufficient to cause a flow through the injector 3 of sufficient velocity to cause the aspiration of washing agent against the threshold pressure of the non-return valve 11, this valve preferably being of the ball-and-spring type. The injector 3, its side inlet 21, and the outlet nozzle 4 thus being inactive, only pure washing fluid, such as water, is transferred from the supply M under high pressure to the one outlet nozzle C being open, and will issue therefrom as a high-velocity jet suitable for rinsing purposes.

If the other one of the outlet nozzles C is opened, then the flow resistance of the conduits (not shown) upstream of the housing inlet 18 will be sufficient to cause a drop in pressure within the housing bore 20, so that the force of the spring 6 will be sufficient to overcome the pressure difference acting on the valving piston 2 and to move the piston through a distance in the downstream direction to the intermediate position shown in FIG. 2. In this position, the flow cross-sectional area of the annular gap 7 is reduced, causing a further drop in pressure in the downstream end of the housing bore 20, but not in the upstream end, the restricted gap lying in-between. The pressure difference acting on the valving piston 2 will now be in the opposite direction, i.e. acting in the downstream direction, and the piston 2 will move further, unaided by the spring 6, to the end position shown in FIG. 3, in which the annular gap 7 is completely closed by its valving surfaces 13 and 14 on the injector inlet nozzle 3 and the piston 2 respectively engaging each other, thus constraining all flow through the injector 3, its side inlet 21, and the outlet nozzle 4. The fluid now leaving the outlet 19, and hence issuing from both of the two outlet nozzles C, will now consist of washing fluid, such as water, with a washing agent, such as a detergent or surfactant, added thereto by being aspirated by the injector 3, its side inlet 21, and the outlet nozzle 4 through the inlet conduit 22, the side inlet 5 and the non-return valve 11 from a washing agent reservoir (not shown). As the pressure at the entrance to the outlet nozzles C is now comparatively low, the mixture of washing fluid and washing agent will issue at a comparatively low velocity, suitable for washing and/or scrubbing purposes.

In the embodiment shown in FIGS. 1–3, the upstream extension 16 on the injector 3, its side inlet 21, and the outlet nozzle 4 is comparatively short, thus leaving a fairly large flow cross-sectional area in the annular gap 7 in the high-pressure rinsing position shown in FIG. 1, so that the pressure drop across this gap is small. This is advantageous when using a low-pressure supply M delivering fluid in the pressure range mentioned above, i.e. between 5 and 10 bars or more, as a high pressure drop at this location could otherwise compromise the effect of the pressure difference caused by the difference in the two effective diameters $d_1$ and $d_2$. At higher supply pressures in the range around 160 bars or more, such as delivered by the supply S shown in FIGS. 4 and 5, it may, however, be expedient to have a smaller flow cross-sectional area in the gap 7 in this position, as this ensures a permanent, but large pressure difference facilitating the transition from an intermediate position (not shown) corresponding to the one shown in FIG. 2 to the end position shown in FIG. 5. The reduced flow cross-sectional area in the annular gap 7' shown in FIGS. 4 and 5 is attained by using an upstream extension 16' of increased axial length. The size of the annular gap 7 or 7' may also be varied by altering the inside diameter of the downstream end of the piston passage 17 and/or the outside diameter of the upstream extension 16 or 16'—or part of same.

In the embodiment shown in FIGS. 6 and 7, the difference between the effective diameters $d_1$ and $d_2$ on the two portions of the piston 2 has been increased by placing the housing inlet 18' laterally to the housing bore 20' and letting a reduced-diameter extension 28 of the piston 2 extend through an opening 29 in the end wall of the housing 1, said opening 29 and reduced-diameter extension 28 being sealed against each other by a seal 30. Holes 31 allow the fluid to pass from the inlet 18' to the piston passage 17'. The embodiment shown in FIGS. 6 and 7 is especially suitable for use with a supply M delivering fluid at a comparatively low pressure, such as from 15 to 20 bars or more, and provides the additional advantage that the protruding end of the piston extension 28 may be used to indicate visually the position of the piston 2, i.e. whether the gap 7 is open or closed.

As can be seen from FIGS. 1, 4 and 6, the quantity of washing agent in direct communication with the side inlet 21 of the injector 3, its side inlet 21, and the outlet nozzle 4 is limited by the volume of the side inlet conduit 22 and the volume of the side inlet 21 itself. As the non-return valve 11 prevents flow of washing agent into these spaces, and the injector 3, its side inlet 21, and the outlet nozzle is "short-circuited" by the bypass conduit(s) 15, the amount of washing agent being carried into the stream of rinsing fluid will be extremely small, if at all perceptible. This effect is enhanced by the fact that the bypass conduit(s) 15 extend(s) in continuation of the annular gap 7 or 7', said gap diverging in the downstream direction, so that the combined flow path consisting of the gap 7 and the bypass conduit(s) 15 will offer a relatively small resistance to the stream of rinsing fluid.

Numerous modifications to the embodiments described above and shown on the drawings are possible within the scope of the present invention as defined in the claims. Thus, the entrance end of the injector's inlet nozzle 3 and the exit end of the injector's outlet nozzle 4 could be fitted with spring-loaded valves, such as non-return valves, in order to completely prevent any washing agent from flowing into the system when the equipment is in the rinsing mode. Such valves would, of course, have to be dimensioned to open at sufficiently low threshold pressures to ensure proper functioning of the injector 3, its side inlet 21, and the outlet nozzle 4.

The materials used for the various components of the aspirator-transfer valve according to the present invention may be such as persons skilled in this art would select in a known manner, such as brass or stainless steel for the rigid parts, synthetic rubber for the seals, and spring steel for the spring 6 and of any valve springs (not shown), such as in the non-return valve 11 and the spring-loaded valves referred to in the preceding paragraph.

It should be noted that the delivery pressures for the supplies M and S referred to above are the so-called "circulatory pressures" of the units concerned. The "circulatory pressure" of units of the kind referred to herein is the pressure measured in the outlet of the unit when the outlet is blocked, and the fluid circulates within the unit whilst the pump is still running. The effective delivery pressure when fluid is being delivered may—due to the nature of the automatic control equipment used in such units—both be higher and lower than said "circulatory pressure", preferably higher. A "circulatory pressure" that is lower than the delivery pressure will, of course, entail a saving in energy when the unit is working against a closed system, as the power lost in pumping fluid against a pressure drop will be less.

I claim:

1. An automatic aspirator-transfer valve comprising:

(a) a housing having one end with a first inlet, a second end with an outlet, a second inlet disposed between said first inlet and said outlet, and a housing bore communicating with said first inlet and extending toward said inlet;

(b) an injector having an inlet nozzle with an upstream extension means, an outlet nozzle and a side inlet, said inlet nozzle communicating with said housing bore, said outlet nozzle communicating with said outlet of said housing, and said side inlet of said injector communicating with said side inlet of said housing by at least one conduit means;

(c) a valving piston positioned in said housing bore and having an upstream end with first surfaces interacting with corresponding surfaces of said housing, a downstream end with second surfaces interacting with corresponding surfaces of said housing and interacting with corresponding surfaces of said upstream extension of said inlet nozzle, a passage extending through said valving piston having an upstream end communicating with said first inlet of said housing and a downstream end communicating with said upstream extension of said injector, and a spring means arranged on said upstream end of said valving piston biasing said valving piston towards said downstream end of said housing, said valving piston being movable from an upstream position to a downstream position by variations in pressure differentials between said surfaces of said upstream end and said downstream end of said valving piston, said valving piston defining a valving gap between said downstream end of said valving piston and said upstream extension of said injector; and (d) at least one bypass conduit extending in said housing and communicating with said valving piston and said outlet of said housing, said bypass conduit separated from said conduit of said side inlet of said injector thereby being in open communication with said passage when said valving piston is in said upstream position and being in closed communication with said passage when said valving piston is in said downstream position.

2. The valve according to claim 1, wherein said downstream end of said valving piston has a surface shape corresponding to a surface of said upstream extension of said inlet nozzle of said injector permitting said piston to fit into said upstream extension in said downstream position and to form said valving gap in said upstream position.

3. The valve according to claim 2 wherein said housing bore, said inlet nozzle with said upstream extension and said outlet nozzle of said injector extend in a downstream direction substantially coaxial with each other, and said valving gap diverges fluid in a downstream direction when opened and said bypass conduit communicates with said valving gap and said housing outlet.

4. The valve according to claim 1, wherein said valve further comprises a spring means arranged on said upstream end of said valving piston, said spring means being biased when said valving piston is moved in said upstream position and being unbiased to move said valving position toward said downstream position when said variations in said pressure differentials occur.

5. The valve according to claim 4, wherein said spring means is positioned on an outside surface of said upstream end of said valving piston.

6. The valve according to claim 1 comprising:

(a) a first means for containing washing fluid which is provided to said valve when said upstream end of said piston is under high pressure;

(b) a second means for containing a washing agent to be provided to said valve and admixed with said washing fluid when said valve is under low pressure; and (c) a gun means having at least one outlet nozzle for fluid exiting from said valve, said gun means having a means for increasing the flow cross-sectional area of said outlet nozzle to lower a pressure in said outlet nozzle from a pressure in a downstream end of said valve to thereby control operation of said valve.

7. The valve according to claim 6 wherein said gun means further comprises: a second outlet nozzle which is alternatively arranged with said first outlet nozzle and is manually controlled to effect a change in said flow cross-sectional area in said outlet nozzle to influence said variations of said pressure differentials in said valve.

8. The valve according to claim 1, wherein said upstream end of said valving piston is stepped and accommodates said spring means thereby biasing said spring means when said valving piston slides from said downstream position to said upstream position against said corresponding surfaces of said housing bore, and said valving piston moves toward said downstream position when said spring means is unbiased.

9. An automatic aspirator-transfer valve comprising:

(a) a housing having one end with a first inlet, a second end with an outlet, a second inlet disposed between said first inlet and said outlet, and a housing bore communicating with said first inlet and extending toward said outlet;

(b) an injector having an inlet nozzle with an upstream extension means, and outlet nozzle, and a side inlet, said inlet nozzle communicating with said housing bore, said outlet nozzle communicating with said outlet of said housing, and said side inlet of said injector communicating with said second inlet of said housing by at least one conduit means, said inlet nozzle with said upstream extension means, said outlet nozzle and said housing bore extending in a direction substantially coaxial with each other;

(c) a valving piston positioned in said housing bore and having an upstream end with first surfaces interacting with corresponding surfaces of said housing, a downstream end with second surfaces interacting with corresponding surfaces of said housing and interacting with corresponding surfaces of said upstream extension of said inlet nozzle, a passage extending through said valving piston having an upstream end communicating with said first inlet of said housing and a downstream end communicating with said upstream extension of said injector, and a spring means arranged on said upstream end of said valving piston biasing said valving piston towards said downstream end of said housing, said valving piston being movable from an upstream position to a downstream position by variations in pressure differentials between said surfaces of said upstream end and said downstream end of said valving piston, said valving piston defining a valving gap by interacting surfaces of said downstream end of said valving piston and said upstream extension of said injector; and (d) at least one bypass conduit extending in said housing and communicating with said valving piston and said outlet of said housing, said bypass conduit separated from said conduit of said side inlet of said injector to thereby receive fluid diverted in said downstream direction into said bypass conduit when said valving piston is in said upstream position to open said valving gap and said bypass conduit not receiving fluid when said valving piston is in said downstream position to close said valving gap.

* * * * *